United States Patent [19]

Knickerbocker

[11] 4,426,026

[45] * Jan. 17, 1984

[54] AEROSOL ASSEMBLY COMPRISING AN IMPROVED OVERCAP

[75] Inventor: Michael G. Knickerbocker, Crystal Lake, Ill.

[73] Assignee: Seaquist Valve Co., Div. of Pittway Corp., Cary, Ill.

[ * ] Notice: The portion of the term of this patent subsequent to May 11, 1999 has been disclaimed.

[21] Appl. No.: 240,021

[22] Filed: Mar. 3, 1981

[51] Int. Cl.[3] ..... B65D 83/14

[52] U.S. Cl. ..... 222/402.13; 222/402.21

[58] Field of Search ..... 222/173, 182, 402.1, 222/402.13, 402.15, 402.21, 402.23, 509; 239/533.12

[56] References Cited

U.S. PATENT DOCUMENTS

| | | | |
|---|---|---|---|
| 3,236,421 | 2/1966 | Glazier | 222/509 |
| 3,759,431 | 9/1973 | Vos | 222/402.21 |
| 3,785,536 | 1/1974 | Graham | 222/402.21 |
| 3,888,392 | 6/1975 | Van Coney | 222/402.13 |
| 3,946,911 | 3/1976 | Morane et al. | 222/402.13 |
| 4,068,782 | 1/1978 | Van der Heijden | 222/402.13 |
| 4,328,911 | 5/1982 | Knickerbocker | 222/402.13 X |

*Primary Examiner*—Charles A. Marmor

*Attorney, Agent, or Firm*—Frijouf, Rust & Pyle

[57] ABSTRACT

An aerosol assembly is disclosed for use with an aerosol container having a valve for discharging product and propellant through a terminal orifice. The invention comprises an actuator button in fluid communication with the terminal orifice. The actuator button is connected to the aerosol valve through a valve stem for opening the aerosol valve upon movement of the actuator button. The actuator button is substantially the shape of a truncated cone having a larger cross-section at the base with respect to the cross-section at the top of the button. A one-piece overcap having an integral finger actuator is secured to the aerosol container for covering the actuator button. Engaging surfaces preferably having plural projections is disposed on the underside of the finger actuator for contacting the actuator button upon movement due to the finger pressure of the operator to open the valve and initiate fluid flow from the terminal orifice.

11 Claims, 16 Drawing Figures

AEROSOL ASSEMBLY COMPRISING AN IMPROVED OVERCAP

BACKGROUND OF THE INVENTION

1. Field of the Invention

This invention relates to fluid sprinkling and spraying and more particularly, to an improved aerosol overcap having a finger actuator in combination with an actuator button.

2. Background of the Invention

Developments in the aerosol industry have produced a wide variety of finger actuator buttons and overcaps for spraying various types of product and propellant. In general, an aerosol container is fitted with an aerosol valve, either of the vertical displacement type or of the tilt valve type wherein the tilting of the valve stem enables discharge of the product and propellant. An actuator button having a terminal orifice is fitted to the valve stem to enable fluid flow therefrom upon actuation of the valve. In most cases, the actuation of the valve is protected by an overcap to prevent unintentional discharge of the contents of the aerosol container.

The prior art has also developed other overcap assemblies wherein a finger actuator is disposed in the overcap for cooperation with the actuator button. In these embodiments, the actuator button, either of the vertical or horizontal spray type, is disposed within and protected by the overcap assembly. The overcap includes a finger actuator for contacting the actuator button to enable fluid flow of product and propellant from the aerosol container through the terminal orifice of the actuator button.

In general, such overcap assemblies in the prior art having finger actuators are complex and extremely difficult to manufacture. In addition, difficulty is also encountered between the cooperation of the finger actuator and the actuator button if there is a misalignment of the actuator button relative to the overcap. Accordingly, the overcaps of the prior art have not been entirely successful due to the complex nature and the required proper alignment which results in extra costs of manufacturing. Although the finger actuator overcaps do present a more pleasing appearance than a standard overcap, the use of the finger actuator overcaps has not found widespread application in the art.

Therefore it is an object of this invention to provide an apparatus which overcomes the aforementioned inadequacies of the prior art devices and provides an improvement which is a significant contribution to the advancement of the prior art.

Another object of this invention is to provide an assembly with a one-piece overcap having a finger actuator in combination with an actuator button wherein the finger actuator is pivotably mounted to the overcap to provide a one-piece overcap assembly.

Another object of this invention is to provide an assembly with a one-piece overcap wherein the finger actuator comprises engaging surface means preferably having plural spaced-apart projections for engaging plural surfaces of the actuator button.

Another object of this invention is to provide an assembly with a one-piece overcap wherein the actuator button is the substantial shape of a truncated cone having a larger cross-section at the base with respect to the cross-section at the top of the button.

Another object of this invention is to provide an assembly with a one-piece overcap wherein the plural projections of the engaging means are spaced apart a distance less than the diameter of the top of the actuator button enabling the plural projections to center the actuator button therebetween.

Another object of this invention is to provide an assembly with a one-piece overcap including an orifice disposed in the finger aperture with the terminal orifice of the actuator button disposed adjacent thereto for enabling discharge of the product from the actuator button in a direction substantially parallel to the axis of the aerosol container.

Another object of this invention is to provide an assembly with a one-piece overcap wherein the overcap, finger aperture and plural projections form a one-piece structure which may be easily molded without overly complex molds.

Another object of this invention is to provide an assembly with a one-piece overcap which is inexpensive and reliable for operation.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into an assembly for use with an aerosol container having an aerosol valve for discharging aerosol product and propellant through a terminal orifice. The invention comprises an actuator button in fluid communication with the terminal orifice. The actuator button is connected to the aerosol valve through a valve stem for opening the aerosol valve upon movement of the actuator button. Either a male or a female actuator button may be used with this invention. The actuator button is in the substantial shape of a truncated cone having a larger cross-section at the base with respect to the cross-section at the top of the button. A one-piece overcap comprises engaging means for securing to the aerosol container to at least partially cover the actuator button. A finger actuator is integrally mounted to the overcap. The finger actuator includes an engaging surface means disposed on the underside of the finger actuator for contacting the actuator button upon movement due to the pressure of the operator to open the valve and initiate fluid flow from the terminal orifice.

The invention may take various forms which are within the scope of the invention as set forth in the claims. For example, the engaging means of the overcap may be disposed about the lower periphery of the cap to engage the outer rim of the aerosol container. The terminal orifice may be integrally disposed in the actuator button or integrally disposed in an insert receivable in the actuator button. Preferably, the finger actuator is pivotably mounted to the overcap with the axis of the pivot being displaced from the axis of the aerosol valve for moving the valve when the engaging surface contacts the actuator button. In this embodiment, the finger actuator is pivotably mounted relative to the overcap through an integral hinge.

The engaging surface means preferably comprises plural spaced apart projections for engaging plural surfaces on the actuator button. The plural projections are spaced apart at a distance less than the diameter of the top of the actuator button enabling the plural projections to center the actuator button therebetween.

The overcap may include an orifice disposed in the finger actuator with the terminal orifice of the actuator button disposed adjacent the finger actuator enabling discharge of the aerosol product through the finger actuator or in a direction generally parallel to the axis of the aerosol container. The plural projections enable the actuator button to be centered relative to the finger actuator orifice prior to discharge of the product therefrom. Although the invention may be suitable for use with either a vertical actuated valve or a tilt valve, the invention is preferably incorporated with a tilt valve with the plural projections being preferably triangular shaped ramps for providing a mechanical advantage to the tilting of the valve stem. The finger actuator orifice may also be elongated enabling fluid flow therethrough irrespective of the angular position of the valve stem.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
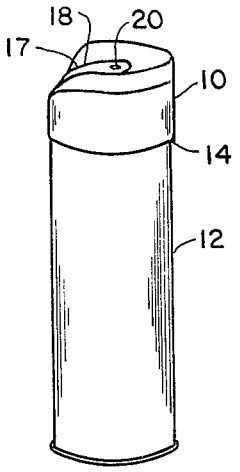
FIG. 1 is a side elevational view of the aerosol apparatus incorporated into a vertical assembly.
Figure 2:
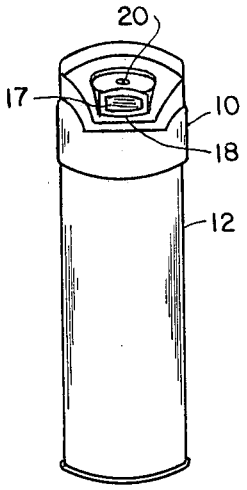
FIG. 2 is a rear elevational view of the assembly shown in FIG. 1.

FIG. 1 is a side perspective view of the novel overcap 10 disposed on an aerosol container 12 containing a propellant and a product. In this embodiment, the overcap 10 is affixed to an upper rim 14 of the aerosol container 12. The overcap 10 covers an actuator button 15 having a terminal orifice 16 shown in FIGS. 3 and 4 with a finger actuator 17 disposed adjacent a finger recess 18 in the overcap 10. An aperture 20 is disposed in the finger actuator 17 for enabling a vertical spray to be discharged substantially along the axis of symmetry of the aerosol container 12. It will be appreciated from the following description that the invention may be suitable for use with either a vertical overcap as shown in FIGS. 1 and 2 or a horizontal overcap (not shown) or other angular positions therebetween, such as a forty-five degree angle spray or the like. It should also be understood that the overcap 10 may be secured to other surfaces of the aerosol container 12 including, but not limited to, the inside or outside rim of the container 12 or the inside or outside rim of the mounting cup or other means.

Figure 3:
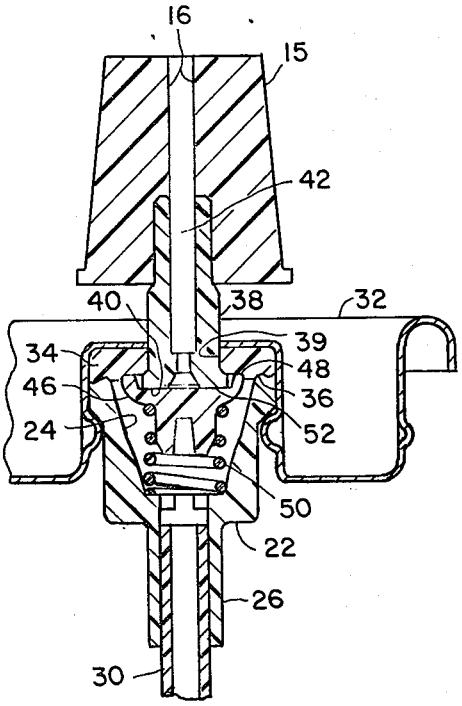
FIG. 3 is an enlarged side sectional view of a valve for use with the overcap assembly shown in FIG. 1 in the unattended position.
Figure 4:
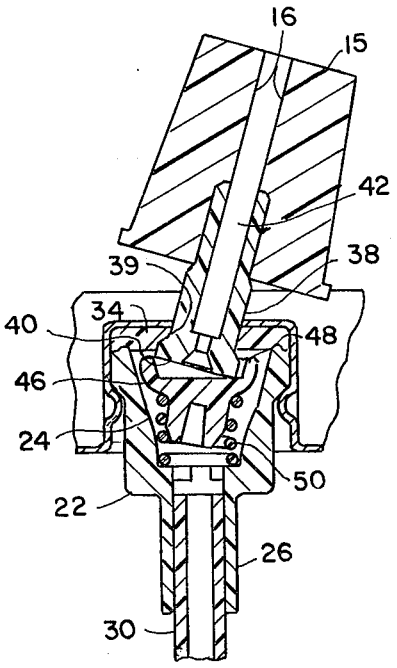
FIG. 4 is a side sectional view similar to FIG. 3 of a valve shown in the tilted position.

FIGS. 3 and 4 illustrate a tilt valve assembly which is suitable for use with the invention set forth herein. A vertical actuator valve (not shown) may be also suitable for use with the present invention. The valve assembly is generally indicated as a tilt valve and includes a valve body 22 having a body cavity 24 formed on the interior thereof. A tail portion 26 is integrally attached or otherwise connected to the valve body 22 and is attached to a dip tube 30. The dip tube 30 is disposed in fluid communication between the interior of the aerosol container 12 and the body cavity 24.

The valve body 22 is mounted to a conventional mounting cup 32 with a sealing gasket 34 disposed in sealing engagement about the upper periphery 36 of the valve body 22. A valve stem 38 having a flat base portion 40 extends through a gasket aperture 39. The stem 38 has a through aperture 42 extending between the substantially flat base 40 and the actuator button 15. A valve stem sealer 46 is disposed within the body cavity 24 with the upper periphery 48 of the valve stem sealer being biased by a spring 50 to form a first seal with the sealing gasket 34.

The substantially flat base portion 40 of the valve stem 38 is supported on a substantially flat platform 52 of the valve stem sealer 46. The cooperation of the flat base 40 and the flat platform 52 provides a second seal to prevent propellant and product from issuing from the dip tube 30 to the valve stem 38. The novel valve design shown in FIGS. 3 and 4 will not open to discharge product and propellant upon a vertical depression of the valve stem, but will open only upon a tilt or a toggle action of the valve stem 38. A vertical movement of the valve stem 38 in FIG. 3 disengages the upper periphery 48 of the valve stem sealer 46 from the gasket 34 but the second seal is still maintained between the flat base 40 and the flat platform 52.

FIG. 4 illustrates the tilting of the valve wherein the tilted valve stem 38 enables the upper periphery 48 to disengage from the sealing gasket 34 while the flat base 40 disengages with the flat platform 52. The product and propellant flows from dip tube 30 around the upper periphery 48 of the valve stem sealer 46 and through aperture 42. As the invention will be set forth herein, it will be made obvious that the present contribution to the art may utilize the disclosed tilt valve of FIGS. 3 and 4 as well as conventional tilt valves or vertical actuator valves (not shown).

Figure 5:
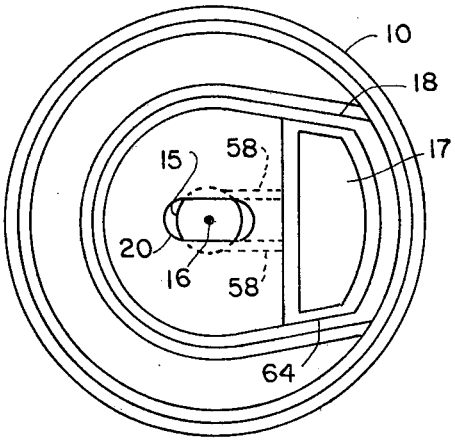
FIG. 5 is a plan view of the aerosol assembly shown in the unattended position.
Figure 7:
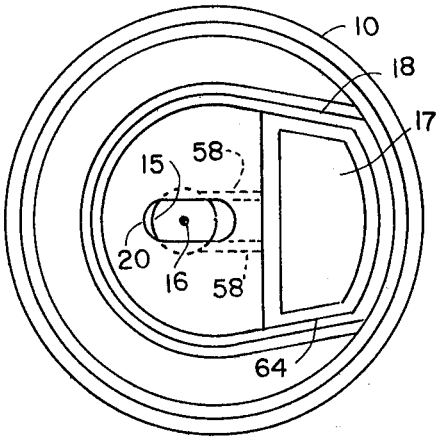
FIG. 7 is a plan view of the aerosol assembly with the overcap being shown in a spraying position.
Figure 6:
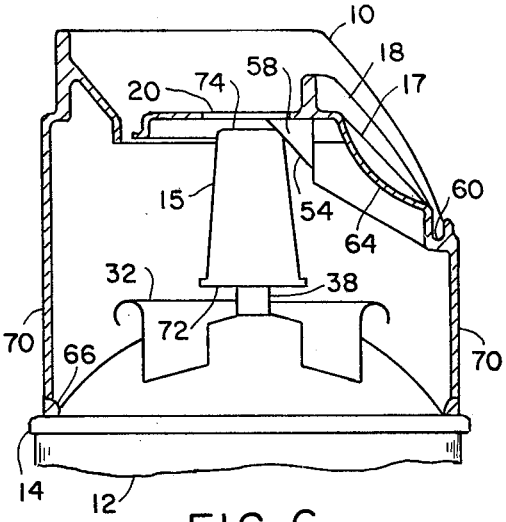
FIG. 6 is a side view, partially in section, of the overcap shown in FIG. 5.
Figure 8:
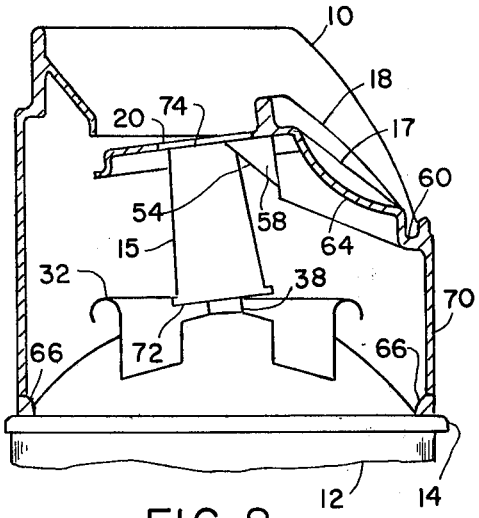
FIG. 8 is a side view partially in section of FIG. 7.
Figure 9:
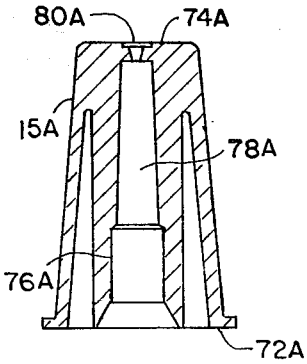
FIG. 9 is a side sectional view of a first actuator button suitable for use with the present invention.
Figure 11:
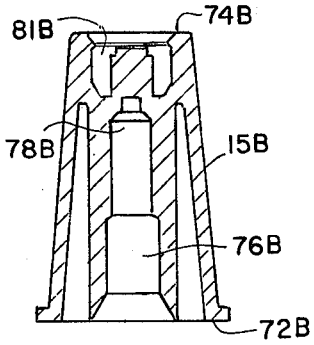
FIG. 11 is a side sectional view of a second actuator button suitable for use with the present invention.
Figure 10:
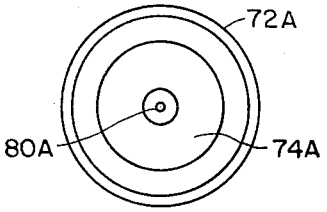
FIG. 10 is a plan view of FIG. 9.
Figure 12:
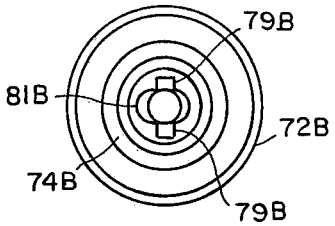
FIG. 12 is a side sectional view of FIG. 11.
Figure 13:
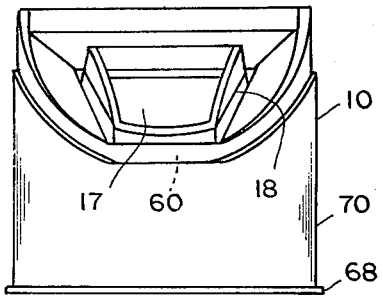
FIG. 13 is a rear elevational view of the overcap.
Figure 14:
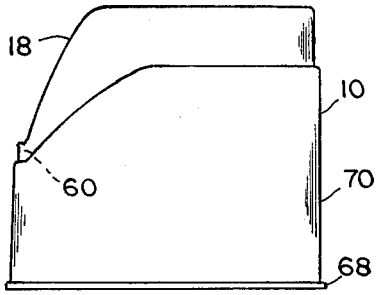
FIG. 14 is a side elevational view of the overcap.
Figure 15:
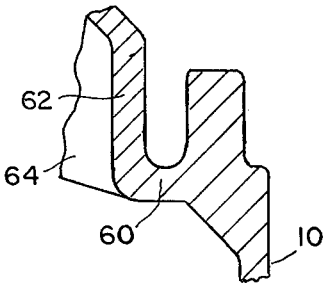
FIG. 15 is an enlarged partial view of a section of the overcap showing details of the integral hinge disposed between the overcap and the finger actuator.

FIGS. 5 and 6 show respectively plan and partial side sectional views of the assembly in an unattended position whereas FIGS. 7 and 8 illustrate the assembly in the spraying position. The finger actuator 17 includes engaging surface means 54 shown as plural projections 58 which are preferably two triangular shaped ribs as shown in FIGS. 6 and 8. The finger actuator 17 is pivoted by an integral hinge 60, more fully shown in FIG. 6, having an increased wall thickness relative to the adjacent wall 62 of the finger actuator 17. The finger actuator 17 includes perpendicular walls 64 shown in FIGS. 6 and 8 to add mechanical strength to the finger actuator 17.

Figure 16:
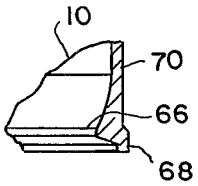
FIG. 16 is an enlarged view of the engaging means of the overcap.

The overcap 10 also includes means for securing the overcap assembly to the aerosol container 12 shown more fully in FIG. 16. The overcap includes an indent 66 and an outer rim 68 in combination with a resilient sidewall 70 to enable a resilient locking of the overcap 10 on the aerosol container 12.

Two embodiments of actuator buttons suitable for use with the present invention are shown in FIGS. 9–12. The actuator button 15A in FIGS. 9 and 10 comprises the substantial shape of a truncated cone having a base 72A and a top 74A. The actuator button 15A further comprises an aperture 76A for receiving a valve stem therein with an aperture 78A leading to an integral terminal orifice 80A. The second embodiment of the actuator button 15B shown in FIGS. 11 and 12 similarly has a base 72B and a top 74B with a valve stem aperture 76B. An aperture 78B leads to plural apertures 79B shown in FIG. 12 into a chamber 81B for receiving with a terminal orifice insert (not shown). It is clear that various suitable types of terminal orifice inserts may be utilized within this actuator valve button 15B.

An important aspect of the invention utilizes the position of the hinge 60, the angular orientation of the projections 58 and the conical shape of the actuator button 15. As can be seen from FIG. 5, the spacing of the projections 58 are less than the diameter of the top 74 of the actuator button 15. This enables the projections 58 to properly center the actuator button 15 upon a finger pressure being applied to the finger actuator 17. As pressure is applied to the finger actuator 17, the angle of the engaging surface 54 compliments the position of the hinge 60 to provide a compound angle to efficiently tilt the actuator button 17. In addition, the actuator button 15 slides along the engaging surfaces 54 of projections 58 as shown by the sequence in FIGS. 6 and 8. The triangular shaped projections 58 compliment the conical shaped button to enable a free movement between the engaging surface 54 and the actuator button 15. As the finger actuator 17 continues to be depressed, the top 74 of the button 15 engages the underside of the finger actuator 17 as shown in FIG. 8 to provide a positive stop to limit the downward depression of the finger actuator 17. The aperture 20 of the finger actuator is elongated to enable the actuator button to properly spray irrespective of the angular position of the actuator button 15 as shown in FIGS. 6 and 8.

The relationship between the shape of the actuator button and the shape of the projections 58 in combination with the position of the hinge 60 provides an efficient means to properly center the actuator button and to efficiently tilt the button to provide efficient spraying for the consumer. This combination when utilized with the novel valve assembly shown in FIGS. 3 and 4 results in a superior design and a substantial advancement in the aerosol art.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been described:

What is claimed is:

1. An assembly for use with an aerosol container having an aerosol valve for discharging aerosol product and propellant through a terminal orifice, comprising in combination:

an actuator button in fluid communication with the terminal orifice;

said actuator button being connected to the aerosol valve through a valve stem for opening the aerosol valve upon movement of said actuator button;

said actuator button having the substantial shape of a truncated cone having a larger cross-section at the base with respect to the cross-section at the top of said button;

a one-piece overcap having engaging means for securing to the aerosol container to at least partially cover said actuator button;

a finger actuator integrally mounted to said overcap;

said finger actuator being pivotably mounted to said overcap with the axis of said pivot being displaced from the axis of the aerosol valve;

engaging surface means disposed on the underside of said finger actuator for contacting said actuator button upon movement due to finger pressure of the operator to open the valve and initiate product and propellant flow from the terminal orifice;

said engaging surface means comprising plural triangular-shaped rib projections for engagement with said truncated cone; and said plural projections being spaced apart a distance less than the diameter of said top of said actuator button for centering said actuator button therebetween;

said triangular-shaped rib projections and said pivot of said finger actuator cooperating to provide a compound angle of movement between said engaging surface means and said actuator button for facilitating opening of the aerosol valve upon movement of said finger actuator by the operator.

2. An aerosol assembly as set forth in claim 1, wherein said engaging means of said overcap is disposed about the lower periphery of said overcap to engage an outer rim of the aerosol container.

3. An aerosol assembly as set forth in claim 1, wherein the terminal orifice is integrally disposed in said actuator button.

4. An aerosol assembly as set forth in claim 1, wherein said finger actuator is pivotably mounted relative to said overcap through an integral hinge.

5. An aerosol assembly as set forth in claim 1, wherein said overcap includes an orifice disposed in said finger actuator with the terminal orifice being disposed adjacent said actuator button for discharging aerosol product through said finger actuator orifice in a direction substantially parallel to the axis of the aerosol container.

6. An aerosol assembly as set forth in claim 5, wherein the aerosol valve opens only upon tilting of the valve stem; and said movement of said finger actuator causing a tilting of the valve stem.

7. An aerosol assembly as set forth in claim 6, wherein said orifice of said finger actuator is elongated for enabling product and propellant flow from said terminal orifice during variable angular orientations of said actuator button.

8. An aerosol assembly as set forth in claim 1, wherein said triangular shaped rib comprises plural spaced apart projections for engaging plural surfaces of said actuator button, said plural projections being spaced apart a distance less than the diameter of the top of said actuator button enabling said plural projections to center said actuator button therebetween; said overcap and said finger actuator and said plural projections being a one-piece structure.

9. An aerosol assembly as set forth in claim 1, including stop means for limiting the extent of movement of said finger actuator relative to said overcap.

10. An aerosol assembly as set forth in claim 9, wherein said stop means includes the top of said actuator button engaging the underside of said finger actuator.

11. An aerosol assembly as set forth in claim 1, wherein said plural projections comprises plural triangular shaped ribs for engagement with said truncated conical actuator button; and said finger actuator being pivoted about an axis displaced from the axis of the aerosol valve providing a compound angle between said pivot and said triangular shaped ribs enabling rapid tilting of said conical actuator button upon application of said pressure to said finger actuator.

* * * * *